US012629795B2

(12) United States Patent
Zhao et al.

(10) Patent No.: US 12,629,795 B2
(45) Date of Patent: May 19, 2026

(54) DEVICE FOR AUTOMATICALLY MEASURING SIDE LENGTH OF MONOCRYSTAL AFTER GRINDING

(71) Applicant: TCL ZHONGHUAN RENEWABLE ENERGY TECHNOLOGY CO., LTD., Tianjin (CN)

(72) Inventors: Wei Zhao, Tianjin (CN); Zhihui Liang, Tianjin (CN); Xizhen Li, Tianjin (CN); Yiqiang Gong, Tianjin (CN)

(73) Assignee: TCL ZHONGHUAN RENEWABLE ENERGY TECHNOLOGY CO., LTD., Tianjin (CN)

( * ) Notice: Subject to any disclaimer, the term of this patent is extended or adjusted under 35 U.S.C. 154(b) by 360 days.

(21) Appl. No.: 18/553,460

(22) PCT Filed: Jun. 26, 2023

(86) PCT No.: PCT/CN2023/102456
§ 371 (c)(1),
(2) Date: Sep. 29, 2023

(87) PCT Pub. No.: WO2024/002018
PCT Pub. Date: Jan. 4, 2024

(65) Prior Publication Data

US 2025/0073848 A1 Mar. 6, 2025

(30) Foreign Application Priority Data

Jun. 27, 2022 (CN) ..... 202221625633.8

(51) Int. Cl.
*B24B 49/04* (2006.01)

(52) U.S. Cl.
CPC ..... *B24B 49/045* (2013.01)

(58) Field of Classification Search
CPC ..... B24B 49/045; B24B 49/04
See application file for complete search history.

(56) References Cited

U.S. PATENT DOCUMENTS 6,026,583 A * 2/2000 Yoshizumi ..... G01B 11/24 33/549
7,065,893 B2 * 6/2006 Kassai ..... G01B 7/002 33/561

(Continued)

FOREIGN PATENT DOCUMENTS

CN 204295504 U 4/2015
CN 205825837 U 12/2016

(Continued)

OTHER PUBLICATIONS

International Search Report in International application No. PCT/CN2023/102456,mailed on Sep. 15, 2023.

(Continued)

*Primary Examiner* — Yaritza Guadalupe-Mccall
(74) *Attorney, Agent, or Firm* — PV IP PC; Wei Te Chung

(57) ABSTRACT

A device for automatically measuring a side length of a monocrystal after grinding may include a detection table, a first driver, a mechanical arm and a probe assembly, the detection table is used for placing the monocrystal to be detected, the measuring devices are symmetrically arranged on both sides of the detection table, one end of the first driver is connected to a side of the detection table, an column is disposed above another end of the first driver, and the first driver is capable of driving the column to move horizontally, the mechanical arm is arranged at a side of the column close to the detection table, and the probe assembly is arranged at one end of the mechanical arm away from the column.

9 Claims, 1 Drawing Sheet

(56) References Cited

U.S. PATENT DOCUMENTS

| | | | | |
|---|---|---|---|---|
| 7,594,339 | B2 * | 9/2009 | Seitz | G01B 5/012 33/503 |
| 8,001,700 | B2 * | 8/2011 | Tondorf | G01D 5/34715 33/702 |
| 8,296,961 | B2 * | 10/2012 | Nakayoshi | B24B 37/042 451/8 |
| 9,421,667 | B2 * | 8/2016 | Gaegauf | B24B 49/10 |
| 9,431,563 | B2 * | 8/2016 | Hosomi | H10F 71/128 |
| 9,599,445 | B2 * | 3/2017 | Ito | B24B 5/04 |
| 10,401,162 | B2 * | 9/2019 | Lummes | G05B 19/401 |
| 2004/0040373 | A1 * | 3/2004 | Saito | B82Y 35/00 73/104 |
| 2008/0172897 | A1 * | 7/2008 | Seitz | G01B 7/012 33/503 |
| 2025/0073848 | A1 * | 3/2025 | Zhao | B24B 49/04 |

FOREIGN PATENT DOCUMENTS

| | | | | | |
|---|---|---|---|---|---|
| CN | 207326735 | U | | 5/2018 | |
| CN | 207971833 | U | * | 10/2018 | |
| CN | 208419812 | U | * | 1/2019 | |
| CN | 110026877 | A | | 7/2019 | |
| CN | 110411634 | A | | 11/2019 | |
| CN | 218341807 | U | * | 1/2023 | B24B 49/045 |
| JP | 2021137942 | A | | 9/2021 | |

OTHER PUBLICATIONS

Written Opinion of the International Search Authority in International application No. PCT/CN2023/102456,mailed on Sep. 15, 2023.

* cited by examiner

DEVICE FOR AUTOMATICALLY MEASURING SIDE LENGTH OF MONOCRYSTAL AFTER GRINDING

CROSS-REFERENCE TO RELATED APPLICATION

This application claims priority to and the benefit of Chinese Patent Application No. 202221625633.8, filed in the China National Intellectual Property Administration on Jun. 27, 2022, the disclosure of which is hereby incorporated by reference in its entirety.

TECHNICAL FIELD

The present disclosure relates to solar monocrystal detection, and in particular to a device for automatically measuring a side length of a monocrystal after grinding.

BACKGROUND

In the manufacture of solar monocrystal silicon wafers, it is necessary to grind and square a monocrystal silicon rod. After the grinding is completed, detection of a side length of the monocrystal after grinding needs to be performed. Conventionally, a vernier caliper is used by an operator to detect the monocrystal after grinding, which may have a large measurement error and low accuracy and thus cannot ensure subsequent production. Moreover, manual measurement is slow and has a lower work efficiency.

SUMMARY

In view of the above, according to an embodiment of the present disclosure, a device for automatically measuring the side length of the monocrystal after grinding includes:

- a detection table for placing the monocrystal to be detected; and
- measuring devices symmetrically arranged on both sides of the detection table,
- each of the measuring devices includes:
- a first driver, one end of the first driver is connected to a side of the detection table, an column is disposed above another end of the first driver, and the first driver is capable of driving the column to move horizontally;
- a mechanical arm disposed on a side of the column close to the detection table; and
- a probe assembly disposed at one end of the mechanical arm away from the column.

List of reference signs:

| | | |
|---|---|---|
| 1. Detection table | 2. First cylinder | 3. Column |
| 4. Second cylinder | 5. Mechanical arm | 6. Probe |
| 61. Base | 62. Probe bar | 63. Top plate |

-continued

List of reference signs:

| | | |
|---|---|---|
| 64. Spring | 65. Light-transmitting hole | 7. First sensor |
| 8. Second sensor | 9. Mounting bracket | 10. Monocrystal to be detected |

DETAILED DESCRIPTION

Some embodiments of the present disclosure will be described below with reference to the accompanying drawings.

Figure 1:
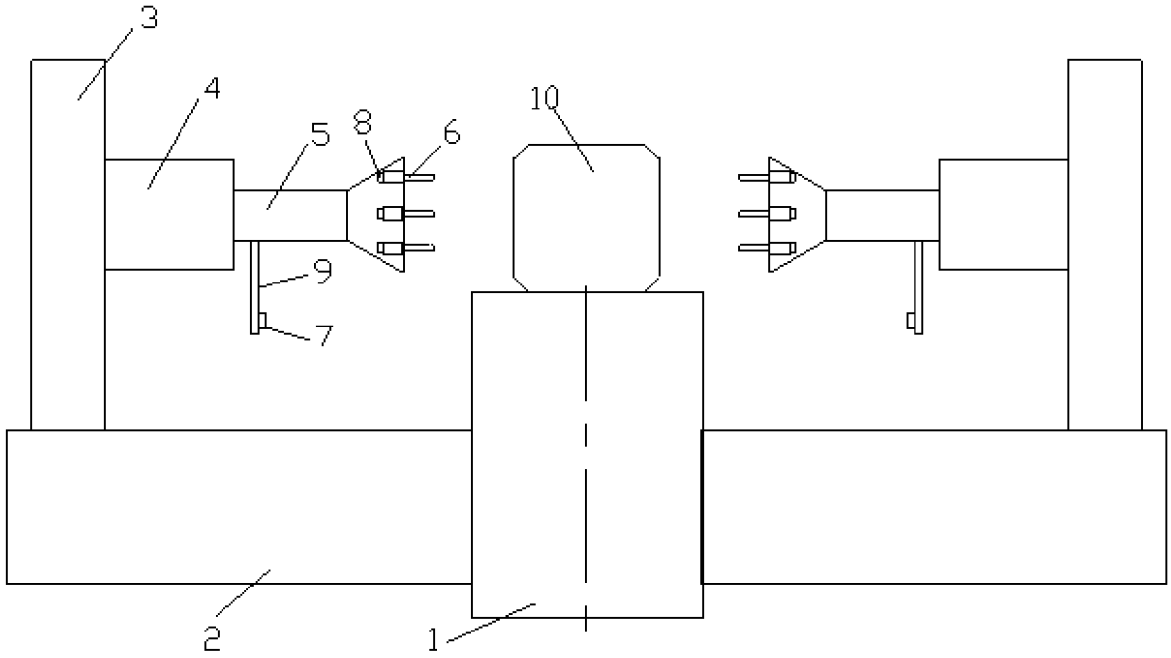
FIG. 1 is a schematic diagram of an overall structure of a device for automatically measuring a side length of a monocrystal after grinding according to an embodiment of the present disclosure.

As shown in FIG. 1, a device for automatically measuring a side length of a monocrystal after grinding according to an embodiment of the present disclosure includes a detection table 1 for placing a monocrystal 10 to be detected, measurement devices are symmetrically mounted on both sides of the detection table 1, and the length direction of the monocrystal 10 to be measured is perpendicular to the connection lines of the measurement devices on both sides. A first driver is mounted on a side surface of the detection table 1, one end of the first driver is connected to the detection table 1, and a column 3 is provided above the other end of the first driver, so that the first driver may drive the column 3 to move horizontally. A horizontal mechanical arm 5 is mounted on one side of the column 3 close to the detection table 1, and a probe assembly is mounted on one end of the mechanical arm 5 away from the column 3.

Specifically, the mechanical arm 5 is provided with a first sensor 7, and the side surface of the detection table 1 is the sensing surface for the first sensor 7. When the first driver drives the column 3 and the mechanical arm 5 to move horizontally, to drive the probe assembly to move, and the distance of the first sensor 7 with respect to the sensing surface is changed, so that the horizontal movement distance of the probe assembly may be detected.

In an embodiment of the present disclosure, a second driver is provided at one end of the mechanical arm 5 close to the column 3, and the second driver may drive the mechanical arm 5 to move horizontally. In order to facilitate the placement of the crystal to be detected on the detection table 1, a second driver is mounted at one end of the mechanical arm 5 close to the column 3, and the second driver may drive the mechanical arm 5 to be horizontally telescoped.

Specifically, the first driver and the second driver may be cylinders or electric telescopic rods.

Specifically, the probe assembly includes a probe 6 and a second sensor 8, the probe 6 is horizontally disposed at one end of the mechanical arm 5 away from the column 3, and the second sensor 8 is disposed at one end of the probe 6 away from the detection table 1, the probe 6 is retractable in a horizontal direction, and the second sensor 8 is used to measure the retraction distance of the probe 6. When the second sensor 8 senses that the probe 6 is in contact with the surface of the object to be measured, and the probe 6 is no longer moved, the first sensor 7 detects the horizontal movement distance of the probe 6. The distance from the column 3 to the center of the detection table 1 is known and constant, and the distance from the column 3 to the probe 6 is also known, so that the distance from the side surface of the crystal to be measured to the center of the operation table may be calculated, and the distance from another side surface of the crystal to be measured to the center of the operation table may be measured by a measuring device symmetrically arranged. The side lengths of the monocrystal 10 to be measured may be obtained by adding the distances from the opposite sides to the center of the operation table. When the probe 6 contacts the side of the crystal to be detected, the probe 6 continues to move, the probe 6 contracts, and the second sensor 8 is able to detect the retraction distance of the probe 6.

Figure 2:
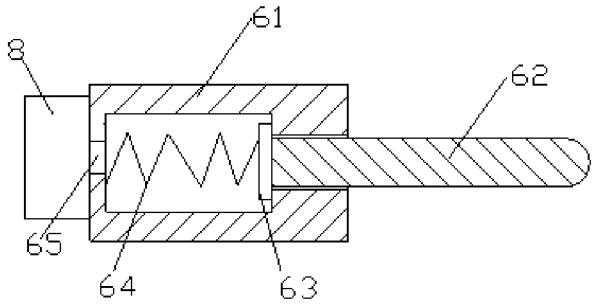
FIG. 2 is a schematic structure diagram of a probe of a device for automatically measuring a side length of a monocrystal after grinding according to an embodiment of the present disclosure.

Specifically, as shown in FIG. 2, the probe 6 includes a base 61 and a probe bar 62, the base 61 is disposed at one end of the mechanical arm away from the column 3, and the probe bar 62 is horizontally disposed at one end of the base 61 adjacent to the monocrystal 10 to be detected and in clearance fit with the base 61. The probe bar 62 is movable horizontally along the base 61, and the second sensor 8 is disposed at the other end of the base 61.

Specifically, as shown in FIG. 2, a top plate 63 is provided at one end of the probe bar 62 away from the monocrystal 10 to be detected, a spring 64 is provided between the top plate 63 and the base 61, and a side of the top plate 63 is a sensing surface for the second sensor 8. When the probe bar 62 contacts the monocrystal 10 to be detected, if the probe bar 62 continues to move, the monocrystal 10 to be detected pushes the probe bar 62 to move along the base 61, and the probe bar 62 pushes the top plate 63 to move, the second sensor 8 may detect the movement distance of the probe bar 62.

In an embodiment of the present disclosure, one end of the probe bar 62 close to the monocrystal is arc-shaped. In order to avoid scratching the monocrystal 10 to be detected when the probe bar 62 is in contact with the monocrystal 10 to be detected, the one end of the probe bar 62 close to the monocrystal 10 is disposed in an arc shape.

In an embodiment of the present disclosure, the probe assembly includes three probes 6 and three second sensors 8, the three probes 6 are placed horizontally and arranged vertically at one end of the mechanical arm 5 away from the column 3, the three sensors are arranged at one end of the three probes 6 away from the detection table 1, respectively. One probe 6 and one sensor are arranged to measure only one side length, and the upper, middle and lower groups of probes 6 are arranged to measure the upper, middle and lower groups of side lengths of the monocrystal, and at the same time, the side length error of the monocrystal 10 to be detected may be monitored to obtain the taper of the monocrystal, thereby ensuring the flatness of the monocrystal.

A device for automatically measuring the side length of a monocrystal after grinding includes a detection table 1, a first cylinder 2, an column 3, a second cylinder 4, a mechanical arm 5, a probe 6, a first sensor 7, and a second sensor 8. The detection devices are symmetrically arranged on both sides of the detection table 1. One end of the first cylinder 2 is connected to a side of the detection table 1, the other end of the first cylinder 2 is fixed to the column 3, one end of the second cylinder 4 is connected to a side of the column 3 close to the detection table 1, the other end of the second cylinder 4 is connected to one end of the mechanical arm 5, and the other end of the mechanical arm 5 is provided with three probes 6, which are horizontally placed and vertically arranged on the mechanical arm 5. The mechanical arm 5 is provided with a mounting bracket 9 for mounting the first sensor 7, and a side surface of the detection table 1 is a sensing surface for the first sensor 7. Second sensors 8 are provided at one ends of the three probes 6 away from the monocrystal 10 to be detected, respectively. The probe 6 is composed of a base 61 and a probe bar 62, the base 61 is provided at one end of the mechanical arm away from the second cylinder 4, and the one end of the base 61 adjacent to the probe bar 62 in a horizontal direction is provided with a stepped hole, the probe bar 62 is in clearance fit with the stepped hole and horizontally movable along the stepped hole. The one end of the probe bar 62 away from the monocrystal 10 to be detected is provided with a top plate 63, one side of the top plate 63 is in contact with the stepped hole, and a spring 64 is provided between the other side of the top plate 63 and the base 61. A second sensor 8 is mounted at one end of the base 61 away from the probe bar 62. The end of the base 61 provided with the second sensor 8 is provided with a light-transmitting hole 65. The top plate 63 is a sensing surface for the second sensor 8. The second sensor 8 may sense the retraction distance of the top plate 63 through the light-transmitting hole 65. In the present embodiment, both the first sensor 7 and the second sensor 8 are laser sensors.

Working flow: the monocrystal 10 to be detected is placed on the detection table 1, and the length direction of the monocrystal 10 to be detected is perpendicular to the connection line of the measuring devices on both sides. The second cylinder 4 is activated to move the mechanical arm 5 horizontally in the direction toward the monocrystal 10 to be detected, and the second cylinder 4 stops moving when the mechanical arm 5 is fully extended. The first cylinder 2 is activated, and the first cylinder 2 moves the column 3, the second cylinder 4, the mechanical arm 5, and the probe 6 horizontally toward the monocrystal 10 to be detected. When all three probes 6 contact the monocrystal 10 to be detected, the first cylinder 2 stops moving, completes the measurement, and then resets.

Measurement principle: since there may be taper on the side of the monocrystal, the three probes 6 do not contact the monocrystal 10 to be detected at the same time. When the last probe 6 contacts the monocrystal 10 to be detected, the first cylinder 2 stops moving, and the probe 6 also stops moving. The first sensor 7 on the mechanical arm 5 detects the horizontal movement distance of the probe 6. The distance from the column 3 to the center of the detection table 1 is known and constant. The distance from the column 3 to the probe 6 is also known. Therefore, the distance from the side of the monocrystal to be detected to the center of the operation table may be calculated. The distance from the side of the crystal to be detected to the center of the operation table on the symmetrical side may be measured by the measuring device arranged symmetrically. The side length of the monocrystal 10 to be detected at this position may be obtained by adding the distances from the opposite sides to the center of the operation table. The remaining two probes 6 are moved in the horizontal direction due to the push of the monocrystal 10 to be detected, to push the respective top plates 63 to move, and the second sensors 8 mounted on the probes 6 measure the respective retraction distances, so that the side length errors of the contact positions of the three probes 6 may be calculated.

The present disclosure has the advantage and the positive effect that the side lengths and the side length errors at the upper, middle and lower positions may be quickly measured by the three probes 6 vertically arranged, so that the measurement time is shortened, the measurement accuracy is improved, the error of the manual measurement is avoided, and the work efficiency is improved.

Some embodiments of the present disclosure have been described in detail above, but should not be considered as limiting the scope of the present disclosure. All equivalents and modifications made in accordance with the present disclosure shall still fall within the scope of the present disclosure.

What is claimed is:

1. A device for automatically measuring a side length of a monocrystal after grinding, comprising:

a detection table for placing the monocrystal to be detected; and measuring devices symmetrically arranged on opposite sides of the detection table respectively, wherein each of the measuring devices comprises:

a first driver with an end connected to a side of the detection table, a column being provided above another end of the first driver, wherein the first driver is capable of driving the column to move horizontally;

a mechanical arm disposed on a side of the column close to the detection table;

a probe assembly disposed at an end of the mechanical arm away from the column; and a first sensor disposed on a mounting bracket on the mechanical arm, the mounting bracket being parallel to the detection table and extending towards the first driver, wherein the first sensor is disposed at an end of the mounting bracket away from the mechanical arm and facing a sensing surface of the detection table and is configured to measure a distance change relative to the sensing surface of the detection table.

2. The device according to claim 1, wherein a side surface of the detection table is the sensing surface for the first sensor.

3. The device according to claim 1, wherein a second driver is provided at an end of the mechanical arm close to the column, and the second driver is capable of driving the mechanical arm to move horizontally.

4. The device according to claim 3, wherein each of the first driver and the second driver comprises a cylinder or an electric telescopic rod.

5. The device according to claim 1, wherein the probe assembly comprises a probe and a second sensor, the probe is horizontally disposed at the end of the mechanical arm away from the column, the second sensor is disposed at an end of the probe away from the detection table, the probe is retractable in a horizontal direction, and the second sensor is configured to measure a retraction distance of the probe.

6. The device according to claim 5, wherein the probe comprises a base and a probe bar, the base is disposed at the end of the mechanical arm away from the column, the probe bar is horizontally disposed at an end of the base close to the monocrystal to be detected and in clearance fit with the base, the probe bar is movable horizontally along the base, and the second sensor is disposed at another end of the base.

7. The device according to claim 6, wherein a top plate is disposed at an end of the probe bar away from the monocrystal to be detected, a spring is arranged between the top plate and the base, and a side surface of the top plate is a sensing surface for the second sensor.

8. The device according to claim 7, wherein an end of the probe bar close to the monocrystal to be detected is arc-shaped.

9. The device according to claim 1, wherein the probe assembly comprises three probes and three second sensors, the three probes are placed horizontally and arranged vertically at the end of the mechanical arm away from the column, and the three sensors are arranged respectively at respective ends of the three probes away from the detection table.

* * * * *